US008733916B2

(12) United States Patent
Kinoshita

(10) Patent No.: US 8,733,916 B2
(45) Date of Patent: May 27, 2014

(54) INKJET APPARATUS

(75) Inventor: Yoshiyuki Kinoshita, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 309 days.

(21) Appl. No.: 13/151,044

(22) Filed: Jun. 1, 2011

(65) Prior Publication Data

US 2011/0298848 A1 Dec. 8, 2011

(30) Foreign Application Priority Data

Jun. 8, 2010 (JP) ..... 2010-131129

(51) Int. Cl.
*B41J 2/19* (2006.01)
*B41J 2/195* (2006.01)
*B41J 2/175* (2006.01)

(52) U.S. Cl.
USPC ..... 347/92; 347/7; 347/85

(58) Field of Classification Search
None
See application file for complete search history.

(56) References Cited

U.S. PATENT DOCUMENTS

| | | | | |
|---|---|---|---|---|
| 4,301,459 | A * | 11/1981 | Isayama et al. | 347/19 |
| 6,334,658 | B1 * | 1/2002 | Suzuki | 347/7 |
| 8,197,043 | B2 * | 6/2012 | Watanabe et al. | 347/85 |
| 2009/0079775 | A1 | 3/2009 | Kimura | 347/14 |

FOREIGN PATENT DOCUMENTS

| | | |
|---|---|---|
| JP | 2001-260389 | 9/2001 |
| JP | 2006-123365 | 5/2006 |
| JP | 2007-015249 | 1/2007 |
| JP | 2007-025254 | 1/2007 |
| JP | 2007-160717 | 6/2007 |
| JP | 2007-223116 | 9/2007 |
| JP | 2008-173816 | 7/2008 |
| JP | 2009-073097 | 4/2009 |

* cited by examiner

*Primary Examiner* — Geoffrey Mruk
(74) *Attorney, Agent, or Firm* — Fitzpatrick, Cella, Harper & Scinto

(57) ABSTRACT

There is provided an inkjet apparatus which can accurately detect an ink remaining amount and shorten time necessary for an ink remaining amount detecting process. This apparatus has a first reservoir unit that reserves ink, a second reservoir unit that reserve the ink supplied from the first reservoir unit to supply the ink to a head, a calculation unit that calculates an ink remaining amount in the second reservoir unit based upon an ink ejection amount ejected from the head, a remaining amount detecting unit that detects the ink remaining amount in the second reservoir unit, a foam processing unit that executes a foam process to reduce foam of the ink generated in the second reservoir unit, and a control unit that controls the execution of the foam process by the foam processing unit based upon comparison between the ink remaining amount calculated and the ink remaining amount detected.

15 Claims, 4 Drawing Sheets

INKJET APPARATUS

BACKGROUND OF THE INVENTION

1. Field of the Invention

The present invention relates to an inkjet apparatus.

2. Description of the Related Art

There is known an inkjet apparatus such as an inkjet type printer or a manufacturing apparatus adopting an inkjet technology, which is constructed such that ink supplied from an ink tank is reserved in an ink reservoir (hereinafter, described as sub-tank) provided therein. The ink reserved in the sub-tank is supplied through an ink supply passage to a print head and is ejected on a print medium from the print head to form an image on the print medium. When the ink in the sub-tank is reduced to a value less than a prescribed value, there is a possibility that air enters into the ink supply passage and is then sent to the print head to deteriorate the quality of a print mage. Accordingly, in order that an ink remaining amount in the sub-tank is not reduced below the prescribed value, it is necessary to detect the ink remaining amount in the sub-tank. At the time of detecting the ink remaining amount in the sub-tank, there is a possibility that there occurs an erroneous detection of the ink remaining amount due to foam of ink generated in the sub-tank.

Japanese Patent Laid-Open No. 2006-123365 discloses the technology in which, for preventing the erroneous detection of the ink remaining amount due to the foam of the ink generated in the sub-tank, a liquid surface height in the sub-tank is detected by a plurality of times to enhance detection accuracy in regard to the ink remaining amount. In addition, this publication discloses the technology in which, under a condition where foam of ink tend to be easily generated, the detection of the ink remaining amount is once more performed when a predetermined waiting time elapses after once detecting the ink remaining amount, thus enhancing the detection accuracy thereof.

However, in a case of performing the ink remaining detection in the sub-tank by the method as disclosed in the above publication, even if the predetermined waiting time elapses, the foam in the sub-tank do not possibly disappear. In a case where the foam do not disappear, there is a possibility that the erroneous detection of the ink remaining amount is not avoidable. In addition, in a case of executing a plurality of ink remaining amount detecting processes, since the same process is repeatedly executed, it takes time to complete all of the ink remaining amount detecting processes.

SUMMARY OF THE INVENTION

An object of the present invention is to provide an inkjet apparatus which is capable of accurately detecting an ink remaining amount and shortening time necessary for an ink remaining amount detecting process.

The inkjet apparatus according to the present invention includes:

a first reservoir unit configured to be removably installed in an apparatus body so as to reserve the ink to be supplied to the head;

a second reservoir unit configured to reserve the ink supplied from the first reservoir unit so as to supply the ink to the head;

a calculation unit configured to calculate an ink remaining amount in the second reservoir unit based upon an ink ejection amount ejected from the head;

a remaining amount detecting unit for detecting the ink remaining amount in the second reservoir unit;

a foam processing unit configured to execute a foam process so as to reduce foam of the ink generated in the second reservoir unit; and a control unit configured to control the execution of the foam process by the foam processing unit based upon comparison between the ink remaining amount calculated by the calculation unit and the ink remaining amount detected by the remaining amount detecting unit.

According to the present invention, by eliminating foam of ink existing in a sub-tank at the time of performing an ink remaining amount detection, it is possible to accurately perform the ink remaining amount detection and shorten the time necessary for the ink remaining amount detecting process.

Further features of the present invention will become apparent from the following description of exemplary embodiments (with reference to the attached drawings).

DESCRIPTION OF THE EMBODIMENTS

An inkjet apparatus according to the present invention is widely applicable to a printing apparatus such as an inkjet type printer or a manufacturing apparatus of an electronic component or various types of articles adopting an inkjet technology. Hereinafter, an inkjet type printer will be explained as an example.

Figure 1:
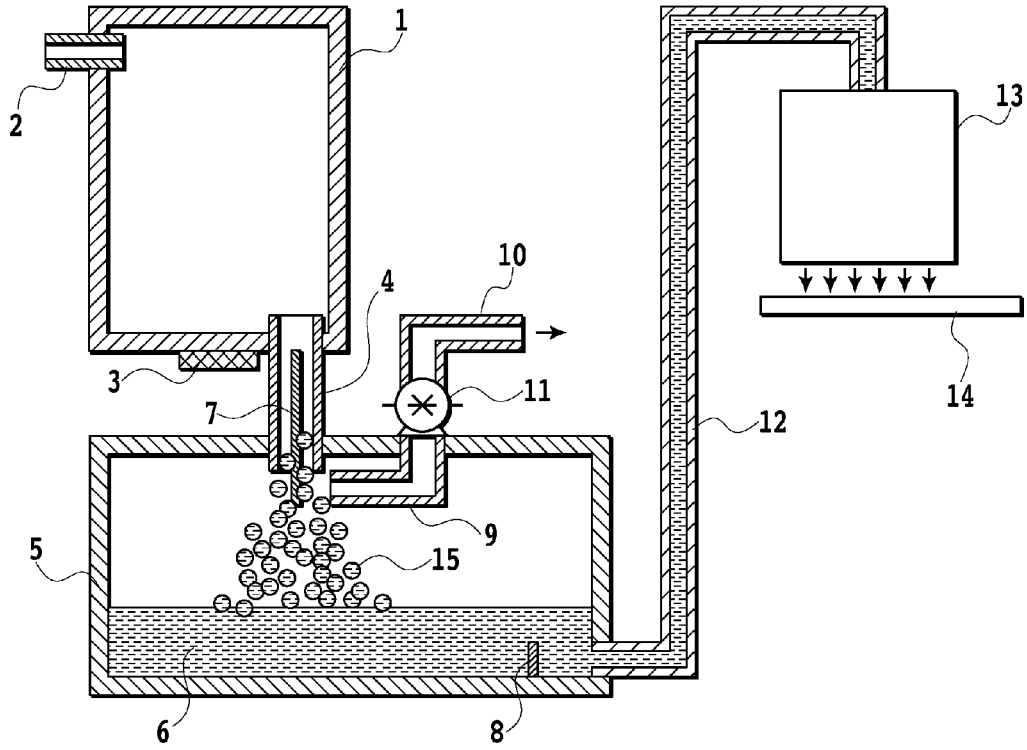
FIG. 1 is a schematic construction diagram showing a printer according to an embodiment in the present invention.

FIG. 1 is a schematic construction diagram showing a printer according to an embodiment in the present invention.

In FIG. 1, at 1 is indicated an ink tank as a first reservoir unit which is removably installed to an inkjet apparatus body. At 2 is indicated an atmosphere communicating port for communicating the ink tank 1 with an atmosphere. At 3 is indicated an involatile memory. At 5 is indicated a sub-tank as a second reservoir unit. The sub-tank 5 is provided in the apparatus. At 4 is indicated an ink filling port which connects the ink tank 1 to the sub-tank 5 to fill ink in the ink tank 1 into the sub-tank 5.

The ink tank 1 is connected through the ink filling port 4 to the sub-tank 5. When outside air is taken into the ink tank 1 from the atmosphere communication port 2, the ink reserved in the ink tank 1 is supplied through the ink filling port 4 to the sub-tank 5.

At 7 is indicated a first electrode for detecting a remaining amount of ink 6 reserved in the sub-tank 5. At 8 is indicated a second electrode for detecting the remaining amount of the ink 6 reserved in the sub-tank 5. In a case where the ink 6 is sufficiently present in the sub-tank 5, since the first electrode 7 and the second electrode 8 both are immersed in the ink 6, electric power can travel between the electrodes. That is, in a case where the electric power travels between the first electrode 7 and the second electrode 8, it is possible to determine that the ink in the sub-tank 5 is sufficiently present. In a case where the ink 6 is present a little in the sub-tank 5, since the first electrode 7 is not immersed in the ink 6, the electric power does not travel between the electrodes. Therefore, in a case where no electric power travels between the first electrode 7 and the second electrode 8, it is possible to determine that the ink in the sub-tank 5 is present a little.

At 9 is indicated a suction port provided in the sub-tank 5. The suction port 9 is in the nearest position of the ink filling port 4 in the sub-tank 5 and is installed in the same position as the height where the first electrode 7 makes contact with the ink 6 reserved in the sub-tank 5. At 10 is indicated a ejecting port which is connected to a disposal ink tank (not shown) and ejects air and foam of the ink 6 sucked from the sub-tank 5 to the disposal ink tank. At 11 is indicated a suction pump which sucks air and foam of the ink in the sub-tank. With this construction, the foam of the ink reserved at least in the periphery of the first electrode 7 can be sucked out by activation of the suction pump 11 to be removed therefrom. At 12 is indicated an ink supply passage for supplying ink to a head 13 from the sub-tank 5. At 13 is indicated the head which ejects ink supplied from the sub-tank 5 on a print medium 14. At the time of executing a printing process, the ejection number of ink droplets ejected for a print from the head 13 and the ejection number of ink droplets ejected for preliminary ejection are counted. In addition, an ink consumption amount consumed by a suction operation of the head or the like can be found by a design value. An ink ejection amount ejected from the head 13 can be calculated from the ejection number of the ink droplets and the ink consumption amount. Calculating the ink ejection amount of the head is also called "dot count". The ink ejection amount found by the dot count is stored in the involatile memory 3. In the present embodiment, there is explained the construction in which the ink tank 1 is provided with the involatile memory 3, but the apparatus body may be provided with the involatile memory. At a point where the ink ejection amount stored in the involatile memory 3 exceeds an ink reserving amount of the ink tank 1, it can be determined that the ink in the ink tank 1 is all consumed. Even in a case where it is determined that the ink in the ink tank 1 is all consumed, the print operation can continue to be performed by the ink 6 reserved in the sub-tank 5. When the ink in the sub-tank 5 is consumed by a predetermined amount after the ink becomes empty in the ink tank 1, a liquid surface of the ink 6 in the sub-tank 5 is lowered below the installation position of the first electrode 7, resulting in no electric power travel between the electrodes. As a result, it is possible to determine that the ink amount in the sub-tank 5 is reduced.

Here, when the ink flows into the sub-tank 5 as the second reservoir unit from the ink filling port 4, there are some cases where foam 15 of the ink are generated. When the foam 15 pool in the periphery of the first electrode 7, even in a case where the ink amount in the sub-tank 5 is a few, there is a possibility that electric power travels through the foam 15 between the first electrode 7 and the second electrode 8. When the electric power travels through the foam 15 between the first electrode 7 and the second electrode 8, there is a possibility that it is in error detected that the ink remaining amount is sufficiently present in the sub-tank 5.

In this case, the ink ejection amount stored in the involatile memory 3 is referred to. In addition, in a case where it is estimated that the ink remaining amount in the sub-tank 5 is less than a predetermined value and the liquid surface of the ink 6 is in a position lower than the position of the first electrode 7, there is a possibility that the erroneous detection of the ink remaining amount occurs. The erroneous detection of the ink remaining amount possibly occurs due to the event that the foam 15 pool in the periphery of the first electrode 7.

Figure 2:
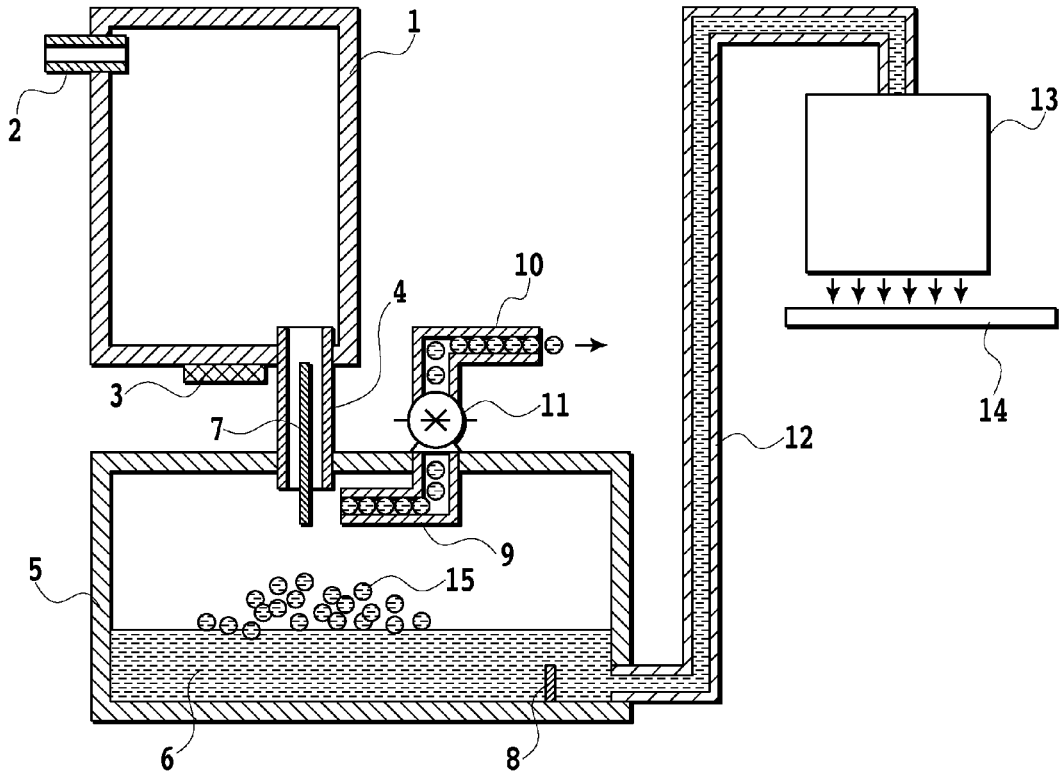
FIG. 2 is a schematic construction diagram showing the other state of the printer in FIG. 1.

In the present embodiment, as shown in FIG. 2, in a case where there is the possibility that the erroneous detection of the ink remaining amount occurs, the suction pump 11 is driven to suck the foam reserved in the periphery of the first electrode 7 through the suction port 9 as a foam processing unit.

That is, the foam process is executed such that the foam are reduced by removing a part or all of the foam 15 of the ink in the sub-tank 5. By removing the foam 15 of the ink with this process, it is possible to avoid the erroneous detection of the ink remaining amount by power travel unintended between the first electrode 7 and the second electrode 8.

In addition, when the suction process for this foam removal is executed in a state where the ink is sufficiently present in the sub-tank 5, there is a possibility of sucking the ink in the sub-tank 5. Therefore, in the present embodiment, the suction process is executed only in a case where there is a possibility that the erroneous detection of the ink remaining amount is occurring. More specially, the ink consumption amount in the ink tank 1 is calculated based upon the ink ejection amount ejected from the head 13. In addition, in a case where it is determined that the ink in the ink tank 1 is all consumed and the ink is present in the sub-tank 5 by the first electrode 7 and the second electrode 8, there is a possibility that the ink remaining amount in the sub-tank 5 is erroneously detected. In this case, the foam removal process is executed. By executing such process, the foam removal process is executed only in a case where there is a possibility that the ink remaining amount in the sub-tank 5 is erroneously detected. In consequence, the foam removal process is not executed for each time of executing the ink remaining amount detecting process, making it possible to shorten the processing time.

The present invention is applied to an inkjet apparatus in which different types of plural ink tanks can be removably installed. In the present embodiment, there will be explained only a system including a single ink tank and a single sub-tank, but in fact, the inkjet apparatus is constructed of the systems provided by the same number as the number of the ink tanks to be installed, each system having the construction illustrated.

Figure 3:
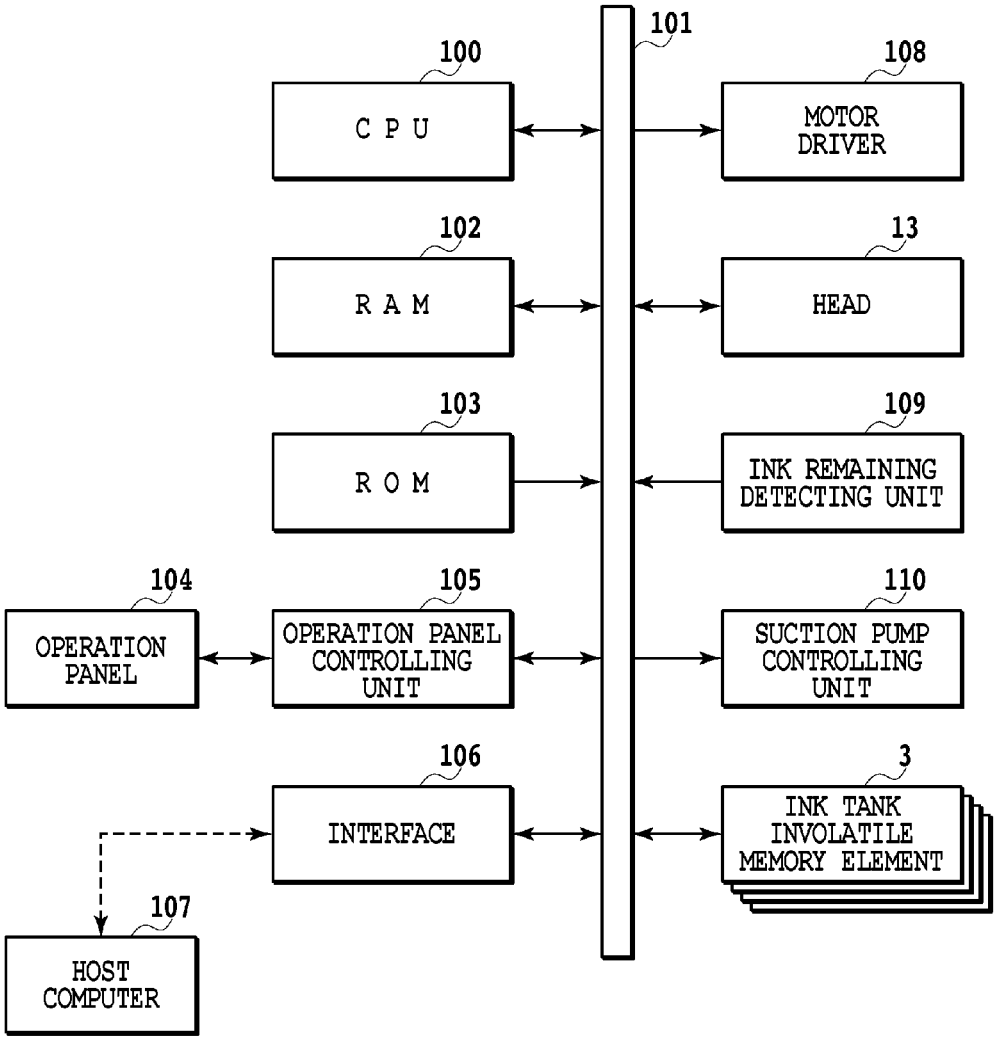
FIG. 3 is a block diagram showing the construction of a control system of the printer in FIG. 1.

FIG. 3 is a block diagram showing a control system of a printer according to an embodiment in the present invention. This control system constitutes a control unit in the present invention.

A CPU 100 is a computation processing apparatus for controlling an entire printer. A bus 101 in a control circuit has a function for connecting the CPU 100 to other apparatuses. A RAM (Random Access Memory) 102 is a storage apparatus which can store information only while power is supplied. When the supply of the power is cut off, the stored information disappears. A ROM (Read Only Memory) 103 is a readable memory and stores control programs of the printer therein. The ROM 103 performs control operations by referring to the programs with the CPU 100. An operation panel 104 has keys for operation and a display panel. An operation panel controlling unit 105 monitors a state of the keys on the operation panel 104 to issue an appropriate control command to the control circuit in the printer including the CPU 100 according to the pressed key. Further, the operation panel controlling unit 105 produces character lines to be displayed on the display panel to perform control of the display panel. In addition, a user can perform a key input by the key arranged on the display panel, and by using this key for operation, it is possible to input an appointment of an operation to the printer apparatus, such as start of a recovery process from the error occurrence state.

An interface 106 connects the printer to a host computer 107 and has a function of receiving data from the host computer 107 and sending statuses to be operable as a communication port for sending/receiving data.

A motor driver 108 is a control circuit for controlling motors such as a carriage motor (operating a print head) for performing a print operation of the printer, a feeding motor (moving a print paper to perform feeding and discharging), and a recovery motor (performing a recovery operation of the head).

An ink remaining detecting unit 109 monitors a power supply state between the first electrode 7 and the second electrode 8 to detect whether or not the ink amount in the sub-tank 5 is lowered below a prescribed level, that is, the ink remaining amount.

A suction pump controlling unit 110 controls a suction pump for sucking air in the sub-tank.

An ink tank involatile memory element 3 represents an involatile memory element provided in each of the plural ink tanks installed in the ink jet apparatus, in which an ink remaining amount in each ink tank is recorded.

Hereinafter, an example of an operation of the control circuit will be explained.

The CPU 100 reads out a control program from the ROM 103 and performs control of each controlling apparatus according to the program. The interface 106 receives print data from the host computer 107 and writes the print data in the RAM 102. The CPU 100 controls the motor driver 108 and the head 13 based upon the written data, and ink is ejected on a print medium based upon the print data to form an image. At this time, the CPU 100 calculates an ink ejection amount based upon the dot count of the ink ejected on the print medium from the head 13, and the calculated ink ejection amount is recorded in the ink tank involatile memory element 3. In a case where the ink in the sub-tank 5 is consumed by a print operation and the like, when the ink in the sub-tank 5 is all used up, air enters into the head 13 and the ejection of the ink is not normally performed. As a result, the quality of the image formed on the print medium is deteriorated. Therefore, it is necessary to stop the process accompanying ink consumption before using up the ink in the ink tank 5 so that the air does not enter into the head 13. For not using up the ink in the sub-tank 5, a threshold value of the ink consumption amount is determined, and the process is stopped at a point where the ink remaining amount in the sub-tank 5 is reduced below the threshold value. While the process of consuming the ink such as the print operation is executed, the ink remaining amount detecting unit 109 determines whether or not the ink liquid surface in the sub-tank 5 is lowered below the first electrode 7. From a point where it is determined that the ink liquid surface in the sub-tank 5 is lowered below the first electrode 7, the ink ejection amount is calculated from the dot count and the ink remaining amount in the sub-tank 5 is found from the calculated ink ejection amount. The process such as the print operation is stopped at a point where the ink remaining amount in the sub-tank 5 is lowered below the above-mentioned threshold value.

Here, when timing, where it is determined that the ink liquid surface in the sub-tank 5 is lowered below the first electrode 7, is delayed, the following problem occurs. That is, even if the process such as the print operation is stopped at a point where the ink remaining amount in the sub-tank 5 calculated by the dot count is lowered below the above-mentioned threshold value, there is a possibility that the ink in the sub-tank 5 is already used up at this point. As a result, there is a possibility that the air is sent to the head 13. As described above, when the foam are reserved in the periphery of the first electrode 7, regardless of the ink amount in the sub-tank 5 is reduced and the ink does not reach to the first electrode 7, there occurs the event that it is determined that a sufficient amount of the ink is present in the sub-tank 5. For avoiding this event, at the time the ink remaining amount detecting unit 9 performs detection of the ink remaining amount in the sub-tank, the detection result of the ink remaining amount detected by the ink remaining amount detecting unit 109 is compared with the ink ejection amount recorded in the ink tank involatile memory element 3. In addition, in a case where there is a difference therebetween, that is, in a case where the relation therebetween is not a predetermined relation, the suction pump 11 is driven by the suction pump controlling unit 110 to suck the air in the sub-tank 5. Since the foam of the ink having been generated in the sub-tank 5 can be removed by sucking the air in the sub-tank 5, detection of the ink remaining amount in the sub-tank 5 is once more carried out by the ink remaining amount detecting unit 109 after the sucking, and therefore, it is possible to correctly detect the ink remaining amount.

Figure 4:
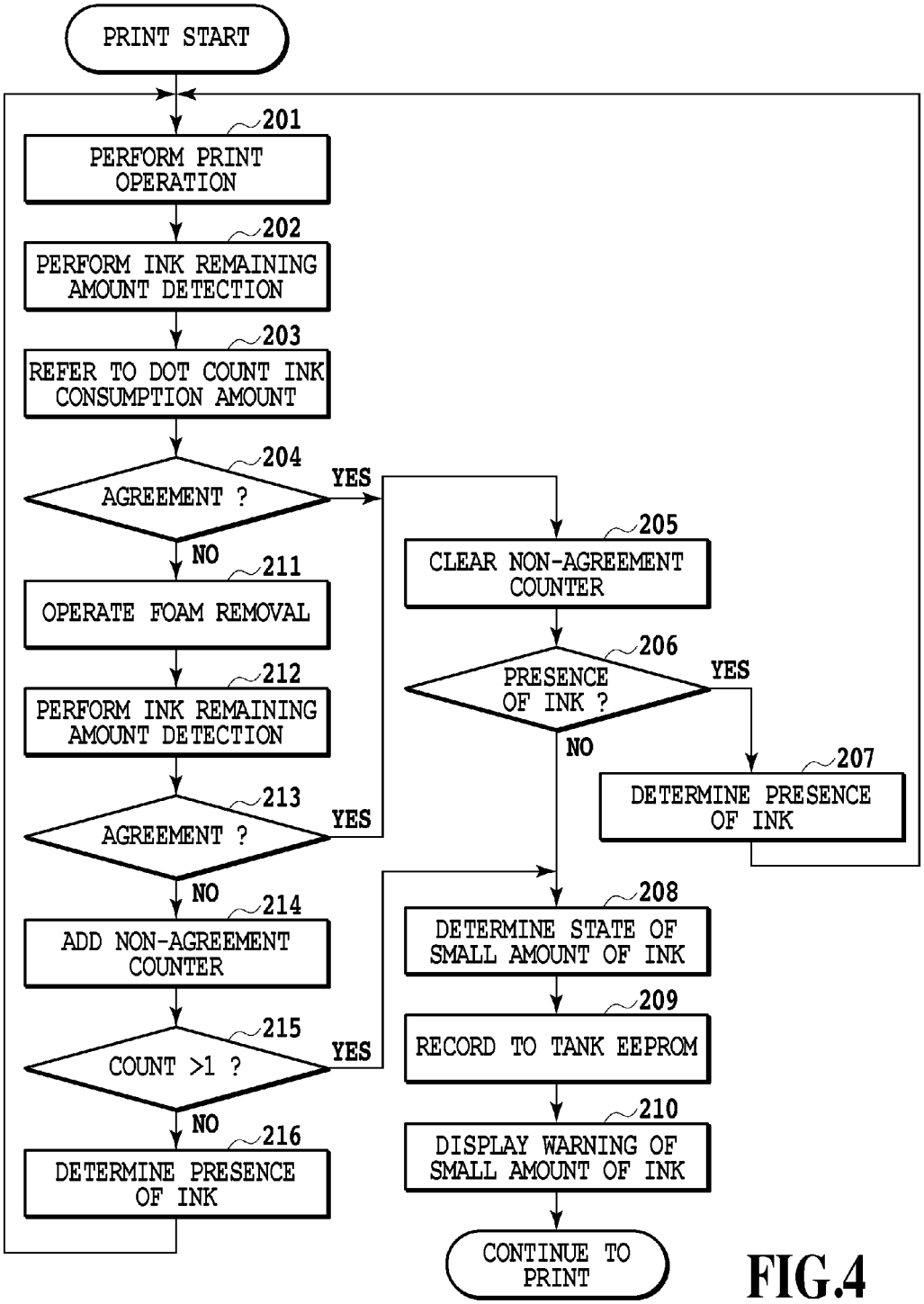
FIG. 4 is a flow chart showing an example of the processing content in the printer.

FIG. 4 is a flow chart showing an example of the ink remaining amount detecting process during the print operating in the above control system.

First, at step 201, a print operation is performed. At step 202, an electrical ink remaining amount detecting process is executed to detect an ink remaining amount in the sub-tank 5. At step 203, by referring to an ink discharge amount calculated by a dot count method, the ink remaining amount in the sub-tank is found. At step 204, the ink remaining amount found at step 202 is compared with the ink remaining amount found at step 203. In a case where both of the ink remaining amounts are in agreement, that is, in a case where there is a given relation therebetween, the process goes to step 205, and in a case where both are not in agreement, that is, in a case where there is not the given relation therebetween, the process goes to step 210. It should be noted that the case where both are in agreement includes not only the case where both are completely in agreement, but also a case where a difference in an ink remaining amount therebetween stays within a predetermined range. At step 205, the number of times of the counter in which both are not in agreement is cleared to zero. At step 206, it is determined whether or not the ink is present in the sub-tank. This determination can be made based upon the ink remaining amount used at step 204. In a case where the ink is present as the determination result, the process goes to step 207, and in a case where no ink is present, the process goes to step 208. At step 207, an ink remaining amount status is set to the presence of the ink, and the process goes back to the head in the flow to continue the print operation. At step 208, the ink remaining amount status is set to a state where the amount of the ink is small. At step 209, the event that no ink is present is recorded in the involatile memory element provided in the ink tank. At step 210, the state where the ink remaining amount is small is displayed on the display panel to inform a user of it, and the print operation continues to be performed in a state where the ink remaining amount is small. In a case where at step 204, both of the ink remaining amounts are not in agreement as a result of the comparison, the process goes to step 211, wherein the suction pump is driven to execute the foam removal process in the sub-tank. At step 212, the electrical ink remaining amount detecting process is once more executed to detect the ink remaining amount in the sub-tank for obtaining the ink remaining amount once more. At step 213, the ink remaining amount found at step 212 is compared with the ink remaining amount once more obtained at step 203. In a case where both of the ink remaining amounts are in agreement as the comparison result, the process goes to step 205, and in a case where both are not in agreement, the process goes to step 214. At step 214, a counter for counting the number of times by which both are not in agreement is incremented. At step 215, it is determined whether or not a value of the counter for counting the number of times by which both are not in agreement is larger than "1". In a case where the value of the counter is equal to "1", the process goes to step 216, and in a case where the value of the counter is larger than "1", the process goes to step 208. At step 216, the ink remaining amount status is set to the presence of the ink and the process goes back to the head in the flow to continue the print operation.

The result of electrically detecting the ink remaining amount in the sub-tank is compared with the result of calculating the ink remaining amount by the dot count method. In a case where both the results are not in agreement, it is possible to obtain an accurate result of the ink remaining amount by executing the foam removal process by the pump provided in the sub-tank.

In addition, the ink remaining amount detecting process is once more executed after executing the foam removal process. In a case where both of the results are once more not in agreement, when the number of times by which both of the results are not in agreement is a predetermined number, for example, when the number is "1", it is determined that the ink is present. When the number of times by which both of the results are not in agreement is more than a predetermined number, for example, when the number is "2" or more, it is determined that the ink is not present or is present a little. Therefore, it is possible to avoid the phenomenon in which regardless of no ink is present in the sub-tank, it is determined that the ink is present, and an image is blurred by sending foam of the ink to the print head. That is, it is determined whether or not the detection results of the first electrode and the second electrode are normal, corresponding to the number of times of executing re-determination processes.

The above embodiment is constructed such that the suction pump 11 pumps foam of the ink reserved in the periphery of the first electrode 7 out of the sub-tank 5 to prevent the erroneous detection of the ink remaining amount in the sub-tank 5. However, the present invention is not limited thereto. For example, there may be provided the construction that the suction pump 11 is driven in a reverse direction to blow out air from the suction port 9 in the sub-tank for blowing away foam 15 of the ink 6 reserved in the vicinity of the first electrode 7.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-131129, filed Jun. 8, 2010, which is hereby incorporated by reference herein in its entirety.

What is claimed is:

1. An inkjet apparatus for printing using a head for ejecting ink, comprising:

a first reservoir unit configured to be removably installed in an apparatus body so as to reserve the ink to be supplied to the head;

a second reservoir unit configured to reserve the ink supplied from the first reservoir unit so as to supply the ink to the head;

a calculation unit configured to calculate an ink remaining amount in the second reservoir unit based upon an ink ejection amount ejected from the head;

a remaining amount detecting unit for detecting the ink remaining amount in the second reservoir unit;

a foam processing unit configured to execute a foam process so as to reduce foam of the ink generated in the second reservoir unit; and a control unit configured to control the execution of the foam process by the foam processing unit based upon comparison between the ink remaining amount calculated by the calculation unit and the ink remaining amount detected by the remaining amount detecting unit.

2. An inkjet apparatus according to claim 1, wherein the control unit executes the foam process by the foam processing unit only in a case where the ink remaining amount calculated by the calculation unit and the ink remaining amount detected by the remaining amount detecting unit are different from each other.

3. An inkjet apparatus according to claim 2, wherein the control unit once more detects the ink remaining amount by the remaining amount detecting unit after executing the foam process, and determines a state of the ink remaining amount in the second reservoir unit based upon the comparison between the ink ejection amount calculated by the calculation unit and the ink remaining amount re-detected by the remaining amount detecting unit.

4. An inkjet apparatus according to claim 3, wherein the control unit determines the state of the ink remaining amount in the second reservoir unit based upon the number of times of the comparison results that the ink ejection amount calculated by the calculation unit and the ink remaining amount redetected by the remaining amount detecting unit are different from each other after executing the foam process by the foam processing unit.

5. An inkjet apparatus according to claim 1, wherein the foam processing unit reduces the foam by sucking at least the foam in the periphery of the remaining amount detecting unit.

6. An inkjet apparatus according to claim 1, wherein the foam processing unit reduces the foam by blowing away at least the foam in the periphery of the remaining amount detecting unit.

7. An inkjet apparatus according to claim 1, wherein the remaining amount detecting unit includes a first electrode and a second electrode provided in the second reservoir unit, and detects the ink remaining amount based upon a power supply state between the first and second electrodes.

8. An inkjet apparatus according to claim 1, wherein the calculation unit calculates the ink ejection amount based upon a count number of ink droplets ejected from the head.

9. An inkjet printing apparatus using a head for ejecting ink, comprising:

a first reservoir unit configured to reserve ink;

a second reservoir unit configured to reserve ink supplied from the first reservoir unit and to be supplied to the head;

a detecting unit configured to detect whether an ink amount in the second reservoir unit is equal to or more than a predetermined amount;

a calculation unit configured to calculate an ink remaining amount in the second reservoir unit based upon an ink ejection amount ejected from the head;

a foam processing unit configured to execute a foam process so as to reduce foam of ink generated in the second reservoir unit; and a control unit configured to control execution of the foam process by the foam processing unit based upon the detection result of the detecting unit and the ink remaining amount calculated by the calculation unit.

10. An inkjet printing apparatus according to claim 9, wherein the control unit controls the foam processing unit to execute the foam process when the ink remaining amount is calculated to be lower than a predetermined amount and the ink amount in the second reservoir unit is detected by the detecting unit as equal to or more than a predetermined amount.

11. An inkjet printing apparatus according to claim 10, wherein the control unit controls the detecting unit to detect whether the ink amount in the second reservoir is equal to or more than the predetermined amount after the foam process is executed.

12. An inkjet printing apparatus to claim 9, wherein the calculation unit calculates the ink ejection amount based upon a count number of ink droplets ejected from the head.

13. An inkj et printing apparatus according to claim 9, wherein the foam processing unit reduces the foam by sucking at least foam in the periphery of the detecting unit.

14. An inkjet printing apparatus according to claim 9, wherein the foam processing unit reduces the foam by blowing away at least foam in the periphery of the detecting unit.

15. An inkjet printing apparatus according to claim 9, wherein the detecting unit includes a first electrode and a second electrode provided in the second reservoir unit.

* * * * *